United States Patent [19]

Badaud

[11] Patent Number: 5,032,814

[45] Date of Patent: Jul. 16, 1991

[54] MOUNTING ASSEMBLY FOR AN IGNITION COIL, IN PARTICULAR FOR AN INTERNAL COMBUSTION ENGINE OF AN AUTOMOTIVE VEHICLE

[75] Inventor: Eric Badaud, St-Remy/Durolle, France

[73] Assignee: Valeo Electronique, Voisins-le-Bretonneux, France

[21] Appl. No.: 510,822

[22] Filed: Apr. 18, 1990

[30] Foreign Application Priority Data

Apr. 28, 1989 [FR] France ..... 8905640

[51] Int. Cl.[5] ..... H01F 15/02

[52] U.S. Cl. ..... 336/65; 336/67

[58] Field of Search ..... 336/96, 65, 66, 67, 336/68, 90, 100; 174/53, 58; 123/634, 635

[56] References Cited

U.S. PATENT DOCUMENTS 4,596,973 6/1986 Form et al. ..... 336/96
4,763,094 8/1988 Kojima ..... 336/96 X

FOREIGN PATENT DOCUMENTS 3636938 5/1988 Fed. Rep. of Germany .
1256436 3/1961 France .
2619164 2/1989 France .
610241 9/1947 United Kingdom .
2199700 7/1988 United Kingdom .

*Primary Examiner*—Thomas J. Kozma
*Attorney, Agent, or Firm*—Dennison, Meserole, Pollack & Scheiner

[57] ABSTRACT

A multiple ignition coil, in particular for an internal combustion engine for an automotive vehicle, has a casing in which are integrated at least two magnetic assemblies, at least two magnetic flux return circuits constituting a metallic armature of the casing, and mounting assembly for anchoring the coil to the vehicle, these mounting assembly comprising metallic cores which are entirely separate from the metallic armature and which are retained by moulding within projecting bosses of the casing.

3 Claims, 1 Drawing Sheet

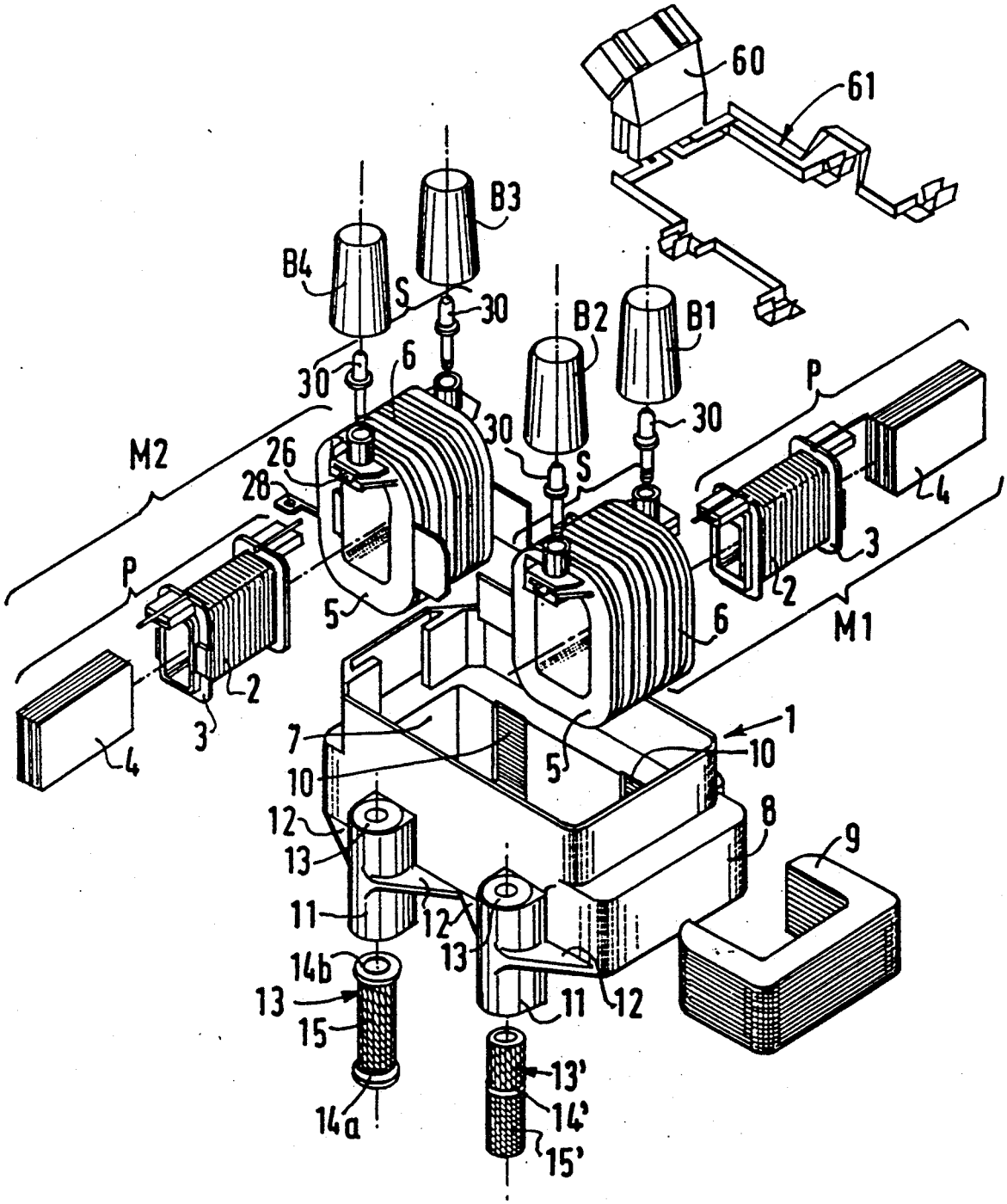
60
61
B3
B4
S
30
B2
B1
30
6
30
30
S
P
M2
26
28
4
3
P
5
2
6
M1
2
3
4
7
1
10
5
10
12
8
13
9
11
12
13
14b
13
11
12
15
13'
14a
14'
15'

MOUNTING ASSEMBLY FOR AN IGNITION COIL, IN PARTICULAR FOR AN INTERNAL COMBUSTION ENGINE OF AN AUTOMOTIVE VEHICLE

FIELD OF THE INVENTION

This invention relates to a multiple ignition coil, in particular for an internal combustion engine of an automotive vehicle, the ignition coil being of the closed magnetic circuit type and comprising a central core around which primary and secondary windings are disposed, the magnetic circuit being integrated into a casing which is moulded from plastic material. The magnetic flux return circuit is integrated into the casing by moulding and to some extent constitutes the metallic armature of the latter.

BACKGROUND OF THE INVENTION

One of the problems to be overcome in a coil of this kind lies in the way in which it is secured to the vehicle. The coil, which serves spark plugs corresponding in number to the number of cylinders in the engine, comprises at least two complete magnetic assemblies housed in a common casing. In consequence, its weight is not insignificant, being due in particular to the primary magnetic cores and to the magnetic flux return circuits which are constituted by a stack of stampled out magnetic laminations.

The anchorage for such an assembly must therefore be particularly effective and solid, so as to be able to resist all the forces to which the coil is subjected in a vehicle. One such anchorage, described in U.S. Pat. No. 4,763,094, involves forming, in the magnetic flux return circuit, holes in which the securing screws, for securing the coil to the vehicle, are engaged. This system does however have a number of disadvantages. Firstly, it necessitates machining of the magnetic flux return circuit, and admission of free air to part of the latter, which inevitably leads to its oxidation. Secondly, such an anchorage, since it forms an integral part of the metallic armature of the coil, has no flexibility which would enable it to absorb the substantial vibrations to which such an assembly is inevitably subjected in a vehicle during operation. This leads to a substantial risk of fracture of the securing screws.

SUMMARY OF THE INVENTION

The present invention enables these problems to be resolved, by providing a securing means which combines sufficiently great mechanical solidity, to enable it to resist forces tending to dislodge the coil, with a positive flexibility which enables it to absorb the effects of vibrations to the greatest possible extent.

To this end, in accordance with the invention, the multiple ignition coil, of the kind defined above, is characterised in that the means for mounting the coil comprise a plurality of metallic cores, separated from the metallic armature and retained by moulding within the projecting bosses of the casing.

In a first embodiment of the invention, the metallic cores comprise metallic inserts, each having a knurled, cylindrical, central portion and frustoconical end portions.

In accordance with a second embodiment of the invention, each metallic insert is cylindrical and includes in its middle zone an annular groove.

The description which follows, given by way of example only and with reference to the accompanying drawings, will afford a better understanding as to how the invention may be carried out in practice.

BRIEF DESCRIPTION OF THE DRAWING

The single FIGURE of the drawing is an exploded view of the various components which constitute the double ignition coil in accordance with the invention.

DESCRIPTION OF THE PREFERRED EMBODIMENT OF THE INVENTION

The drawing is an exploded view of the various elements of an ignition coil 1 for an internal combustion engine of an automotive vehicle. In the example shown, the coil is arranged for supplying the four spark plugs corresponding to the four cylinders of the engine. Accordingly, it is a double coil comprising two separate but identical magnetic circuits M1 and M2. Each of these magnetic circuits is a closed circuit, and includes a primary winding 2 which is wound on a primary former 3. A central magnetic core 4, having a rectangular profile and consisting generally of magnetic laminations, formed by pressing and stacked together, is mounted within the former 3.

Around each of these assemblies (which we will call the primary assembly P), there is disposed a secondary former 5, around which a secondary winding 6 is wound. We will call this a secondary assembly S. Each secondary assembly S is maintained in position on and around the primary assemply P.

Four output terminals B1, B2, B3 and B4 are disposed on the secondary assemblies S. Each of these output terminals is adapted to be connected in a conventional way, through an appropriate cable, to a spark plug associated with each cylinder of the engine. Each high tension terminal B1, B2, B3 or B4 includes a high tension terminal pin 30 which is secured by being screwed into a connecting strip 28, the latter having been inserted beforehand into a slot. The end of the secondary winding is soldered to one end of the connecting strip 28. The low tension connection is obtained by means of a connection assembly comprising a performed connecting strip member 61 which is inserted into a connector 60.

When the primary assemblies P have been assembled into the secondary assemblies S, the two magnetic circuits M1 and M2, thus constructed, are introduced into the housing cavity 7 of a casing 8 made of insulating material. For each magnetic assembly M1, M2, a magnetic flux return circuit 9, generally of U shape and comprising a stack of pressed out magnetic laminations, is incorporated by moulding into the casing 8. After moulding, only the rectangular surfaces 10 of these laminations, which lie facing each of the magnetic cores 4 of the primary assembly P, are exposed. The magnetic flux return circuits 9 therefore constitute the metallic armature of the casing 8. External bosses 11, which are connected through ribs 12 to the casing 8, are formed integrally with the latter during its moulding. Metal inserts 13 are located in the bosses 11, and together with the latter these constitute the means for securing the coil assembly to the vehicle itself.

These inserts 13 constitute metallic cores which are compeltely separate mechanically from the metallic armature of the casing 8. In a first embodiment, each of these cores or inserts 13 comprises a cylindrical central portion 15, which is knurled, together with frustoconical end portions 14*a* and 14*b*. The knurling enables better adhesion of the insulating material of the casing 8 to be obtained during the moulding operation. The frustoconical end portions 14*a* and 14*b* prevent the cores 13 from moving axially.

In a second embodiment, the cores 13' are generally cylindrical in shape as indicated at 15', with an annular groove 14' formed around the cylindrical surface of each core for adherence of the latter to the material of the insulating casing 8 during the moulding operation.

In this way means are provided for mounting or securing the double ignition coil 1, such that the mounting or securing means are sufficiently rigid to overcome dislodging forces, because of the sufficiently large dimensions that are given to the metallic cores 13. Since the bosses 11 of the casing 8 are mechanically independent of the rigid portion of the casing 8, the mounting or securing means whereby the coil is fastened to the vehicle, as described above, have a degree of natural mechanical flexibility which allows vibration effects to be contained without any danger of deterioration of the whole.

The invention is not limited to the embodiment described and shown, and may be modified in any desirable way without thereby departing from the scope of the invention.

What is claimed is:

1. In an ignition coil for an internal engine and mounting assembly therefor:

a plurality of magnetic circuits, each said magnetic circuit including a primary and secondary assembly, said primary assembly including a first former defining a first cavity, a primary winding extending around said primary former, and a central magnetic core mounted within said first cavity;

said secondary assembly including a second former defining a second cavity, a secondary winding extending around said secondary former, said secondary cavity receiving said primary assembly, the combination comprising:

a rectangular shaped plastic casing defining a housing cavity for receiving said plurality of magnetic circuits, said casing including a hollow portion incorporating a plurality of stacked magnetic laminations, said casing further including an inner face, means defining a plurality of pairs of openings in said casing and extending through said inner face, said pairs of openings being positioned to align with said central magnetic cores to expose a portion of said plurality of stacked magnetic laminations to said respective central magnetic cores to form in combination therewith a metallic armature, said casing further including means defining an outer face, mounting means formed integrally with said casing and extending from opposed sides of said outer face, said mounting means including at least two bosses on each of said opposed sides, each of said bosses connected to said casing by a rib formed of single-piece construction with its respective boss and said outer face, vibration insulation means positioned within each said boss and constituting a metallic core having a knurled cylindrical central portion configured to isolate said ignition coil from vibrations generated by the internal combustion engine on which said coil is mounted.

2. In an ignition coil for an internal combustion engine and mounting assembly according to claim 1, wherein each said metallic core includes an insert having at least one frustoconical end portion.

3. In an ignition coil for an internal combustion engine and mounting assembly according to claim 1, wherein each said metallic cores includes an insert having a cylindrical surface with an annular groove formed therein.

* * * * *